US007937021B2

(12) United States Patent
Sezaki et al.

(10) Patent No.: US 7,937,021 B2
(45) Date of Patent: May 3, 2011

(54) IMAGE FORMING APPARATUS WITH FIXING DEVICE INCLUDING CONTACT PORTION LOWER THAN TRANSPORT FACE

(75) Inventors: Yukinori Sezaki, Saitama (JP); Shinichi Sakai, Saitama (JP); Takeshi Okoshi, Saitama (JP)

(73) Assignee: Fuji Xerox Co., Ltd., Tokyo (JP)

( * ) Notice: Subject to any disclaimer, the term of this patent is extended or adjusted under 35 U.S.C. 154(b) by 312 days.

(21) Appl. No.: 11/517,321

(22) Filed: Sep. 8, 2006

(65) Prior Publication Data

US 2007/0280728 A1 Dec. 6, 2007

(30) Foreign Application Priority Data

Jun. 1, 2006 (JP) ..... P2006-153231

(51) Int. Cl.
*G03G 21/16* (2006.01)

(52) U.S. Cl. ..... 399/111; 399/112

(58) Field of Classification Search ..... 399/111, 399/303, 107, 66, 299, 112
See application file for complete search history.

(56) References Cited

U.S. PATENT DOCUMENTS 5,081,506 A * 1/1992 Borostyan ..... 399/305
5,166,735 A * 11/1992 Malachowski ..... 399/68
6,058,287 A * 5/2000 Haneda et al. ..... 399/397
6,160,980 A * 12/2000 Ziegelmuller et al. ..... 399/303
6,505,030 B1 * 1/2003 Santiago et al. ..... 399/389
7,079,804 B2 * 7/2006 Ando et al. ..... 399/400
7,636,533 B2 * 12/2009 Kikuchi et al. ..... 399/167
2002/0061210 A1 * 5/2002 Ashibe et al. ..... 399/302
2003/0091368 A1 * 5/2003 Yamamoto et al. ..... 399/116
2004/0009004 A1 * 1/2004 Mizoguchi ..... 399/90
2005/0008407 A1 * 1/2005 Kamiya ..... 399/302
2005/0053388 A1 * 3/2005 Yokoyama et al. ..... 399/66
2005/0207798 A1 * 9/2005 Okabe ..... 399/299
2007/0019998 A1 * 1/2007 Inui et al. ..... 399/303

FOREIGN PATENT DOCUMENTS

JP 61296373 A * 12/1986
JP 03123379 A * 5/1991
JP 3398064 B2 3/2000
JP 2000066471 A * 3/2000
JP 2001100488 A * 4/2001

OTHER PUBLICATIONS

Computer translation of JP2000-0066471A; publication associated with applicant cited document 3398064B2.*

* cited by examiner

*Primary Examiner* — Quana M Grainger
(74) *Attorney, Agent, or Firm* — Sughrue Mion, PLLC

(57) ABSTRACT

An image forming apparatus includes: a body; a transport belt that includes a transport face, and that transports the sheet while supporting the sheet on a transport face; a developer-image forming portion that forms a developer image on the sheet transported by transport belt; and a fixing device that includes a contact portion disposed lower position than the transport face, and that fixes the developer image on the sheet by the contact portion.

10 Claims, 5 Drawing Sheets

IMAGE FORMING APPARATUS WITH FIXING DEVICE INCLUDING CONTACT PORTION LOWER THAN TRANSPORT FACE

BACKGROUND

Technical Field

The present invention relates to an image forming apparatus such as a copier, a facsimile apparatus, or a printer.

SUMMARY

According to an aspect of the invention, an image forming apparatus including: a body; a transport belt that includes a transport face, and that transports the sheet while supporting the sheet on a transport face; a developer-image forming portion that forms a developer image on the sheet transported by transport belt; and a fixing device that includes a contact portion disposed lower position than the transport face, and that fixes the developer image on the sheet by the contact portion.

BRIEF DESCRIPTION OF THE DRAWINGS

An exemplary embodiment of the present invention will be described in detail based on the following figures, wherein:

FIG. 4A is a first diagram that illustrates a tension roll used in the exemplary embodiment of the invention, and FIG. 4B is a diagram that illustrates a tension roll used in a comparison example.

DETAILED DESCRIPTION

Next, an exemplary embodiment of the invention will be described with reference to the accompanying drawings.

Figure 1:
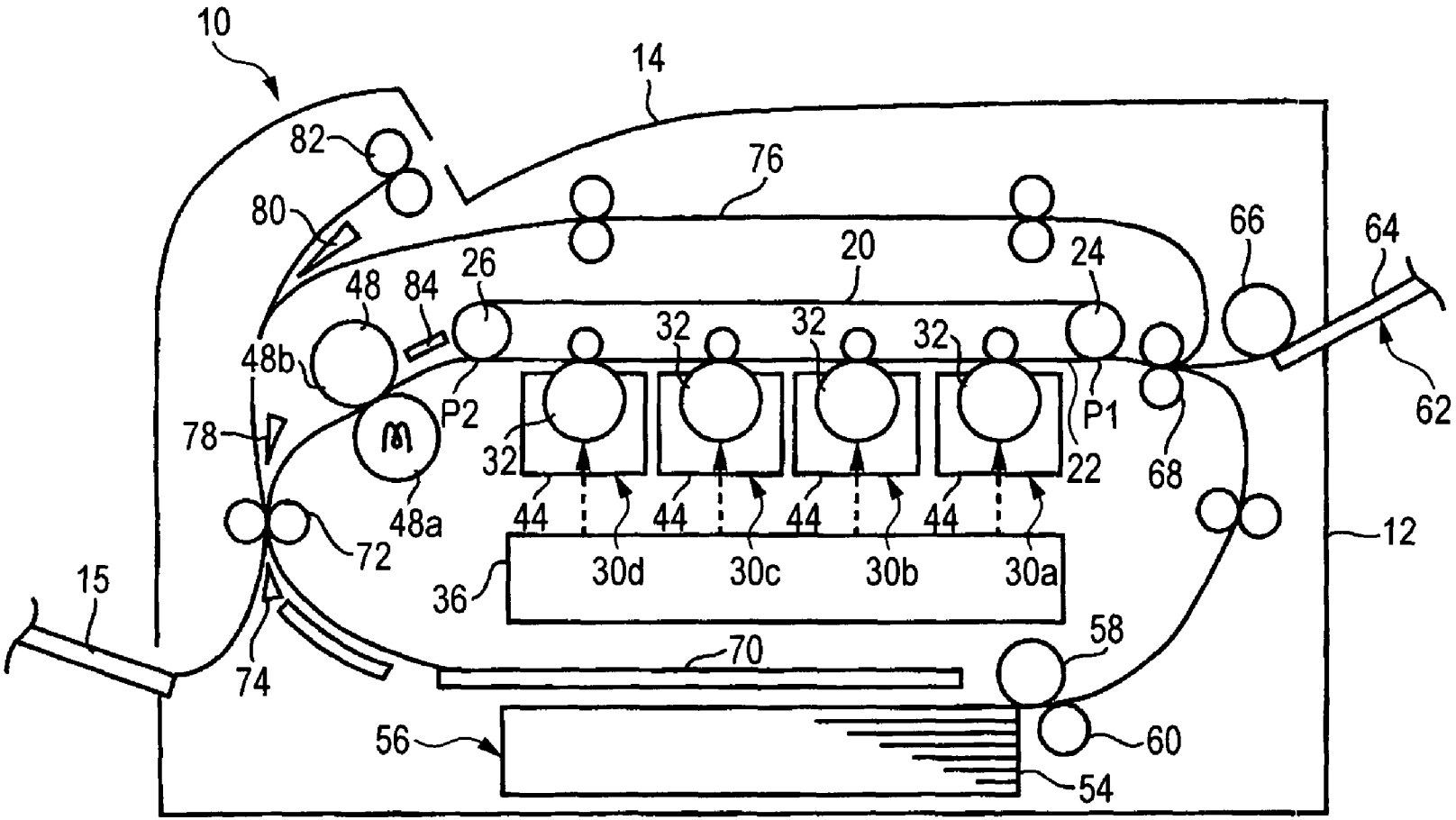
FIG. 1 is a section view that illustrates the configuration of an image forming apparatus of an exemplary embodiment of the invention.
Figure 2:
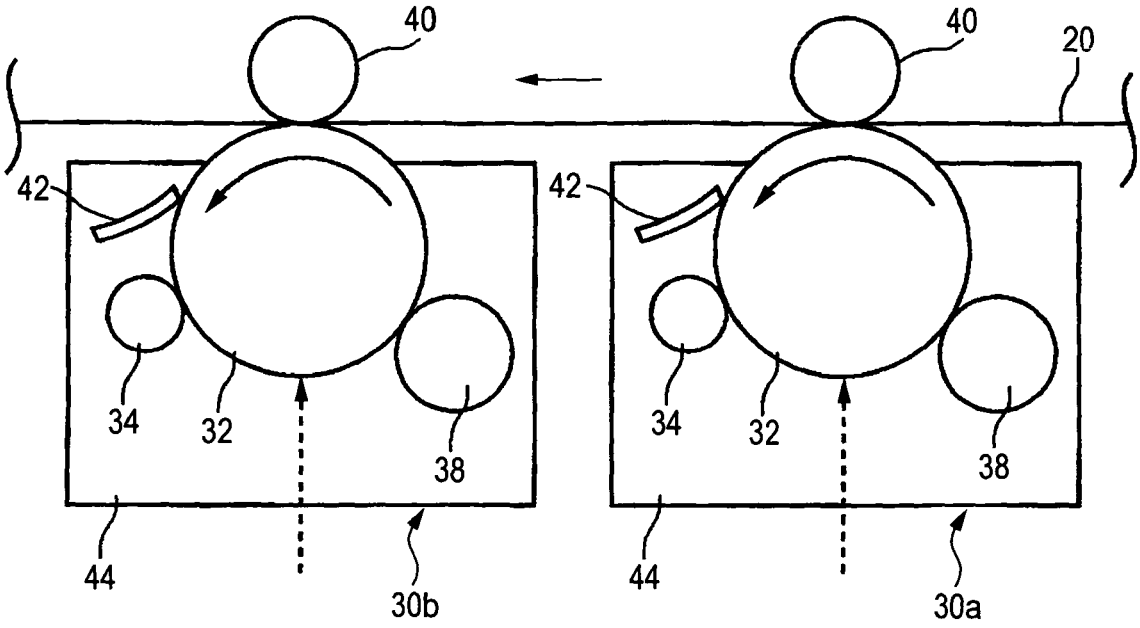
FIG. 2 is a section view that illustrates cartridges used in the image forming apparatus of the embodiment of the invention.
Figure 3:
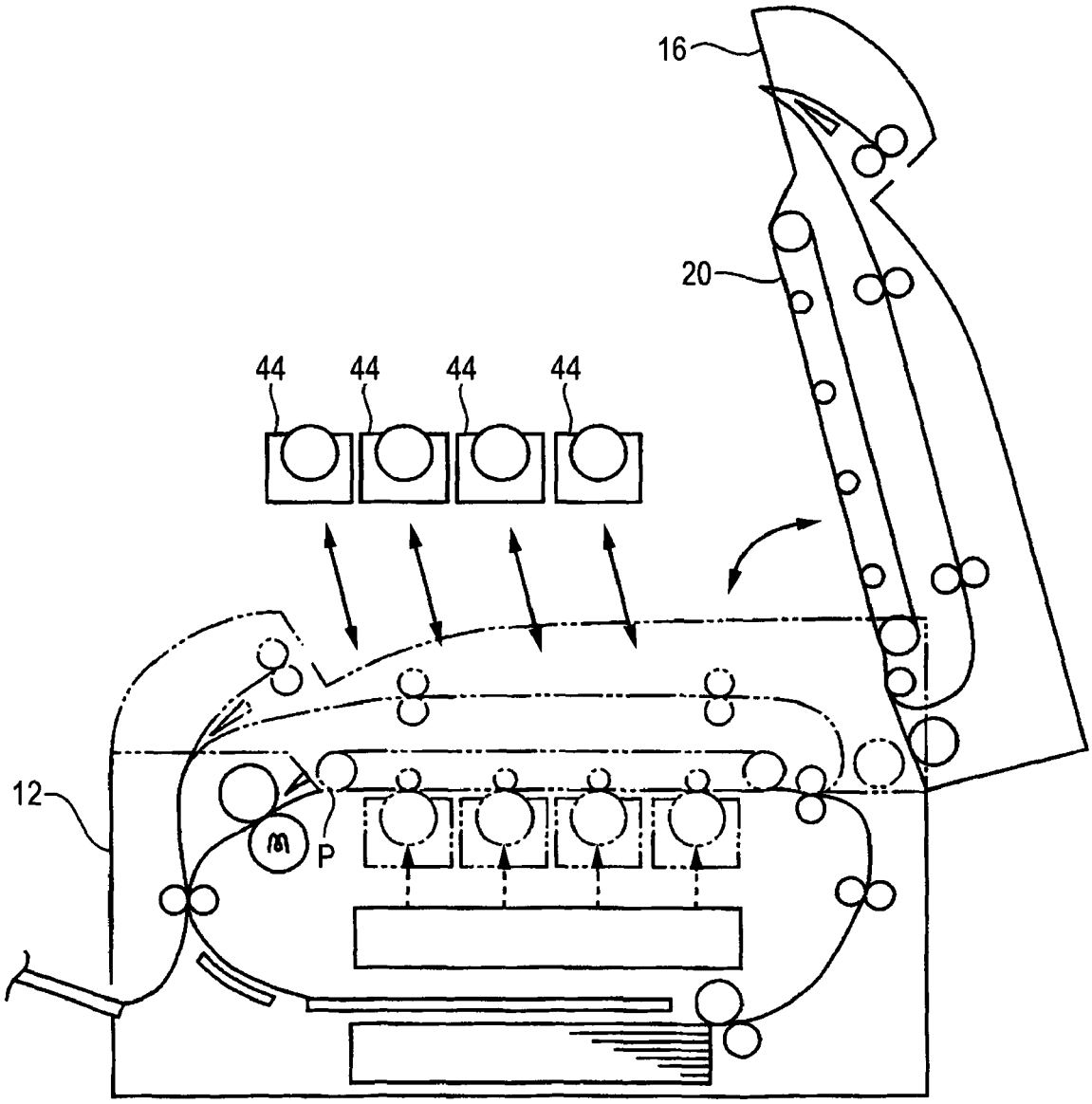
FIG. 3 is a diagram that illustrates a state where cartridges are attached to and detached from a body of the image forming apparatus of the exemplary embodiment of the invention.

FIGS. 1 to 3 show an image forming apparatus 10 of the embodiment of the invention. The image forming apparatus 10 has an image forming apparatus body 12. An upper discharge portion 14 to which a sheet such as plain paper is discharged, and which is used as a first discharge portion is formed in an upper portion of the image forming apparatus body 12. A discharge tray 15 on which a sheet is discharge, and which is used as a second discharge portion is disposed on a side face that is on the left side of the image forming apparatus body 12 in FIG. 1. An upper portion of the image forming apparatus body 12 is configured as an openable and closable cover 16 which can be opened and closed between a closed position shown in FIG. 1 and an opened position shown FIG. 2.

A transport belt 20 which transports a sheet is disposed in the image forming apparatus body 12. The transport belt 20 transports a sheet while sucking the sheet by a transport face 22 which is downward directed in the gravitational direction. In the embodiment, the transport face 22 is a face which is downward directed in the gravitational direction. The transport face 22 is requested to have a component which is downward directed in the gravitational direction, and may be an inclined face having a vertical component.

The transport belt 20 is stretched by a tension roll 24 which is disposed on the upstream side in the sheet transport direction, and a tension roll 26 which is disposed on the downstream side in the sheet transport direction. In the transport belt 20, the above-mentioned transport face 22 is formed between lower end portions of the tension rolls 24, 26. The tension roll 24 is located on the back of a position P1 where a fed sheet is to be sucked to the transport belt 20, and the tension roll 26 is located on the back of a position P2 where the sheet is to be separated from the transport belt 20. In the embodiment, the transport belt 20 is stretched by the two tension rolls or the tension rolls 24, 26. Alternatively, the transport belt 20 may be stretched by three or more tension rolls.

The tension rolls 24, 26 are attached to the openable and closable cover 16. In accordance with opening and closing operations of the openable and closable cover 16, therefore, the transport belt 20 is moved between a first position which is shown in FIG. 1, and at which the belt is used for transporting a sheet, and a second position which is shown in FIG. 2. When a sheet transportation failure occurs on the transport face 22, for example, the sheet can be removed away through an open portion which is formed by moving the transport belt 20 to the second position. In the embodiment, the transport belt 20 is stretched by the tension rolls 24, 26 which are attached to the openable and closable cover 16, and configured so as to be moved between the first and second positions in accordance with opening and closing operations of the openable and closable cover 16. Alternatively, the transport belt 20 may be configured so as to be moved between the first and second positions independent of the openable and closable cover 16.

Four developer-image forming portions 30*a*, 30*b*, 30*c*, 30*d* which form a developer image on the sheet transported by the transport belt 20 are disposed below the transport belt 20 in the image forming apparatus body 12. In this way, the image forming apparatus 10 has plural developer-image forming portions. The developer-image forming portion 30*a* forms a yellow developer image on a sheet, the developer-image forming portion 30*b* forms a magenta developer image on the sheet, the developer-image forming portion 30*c* forms a cyan developer image on the sheet, and the developer-image forming portion 30*d* forms a black developer image on the sheet. These developer images are superimposed together on the sheet transported by the transport belt 20, to form a full-color developer image on the sheet.

Each of the developer-image forming portions 30*a*, 30*b*, 30*c*, 30*d* has a photosensitive member 32 which is used as an image carrier. As shown in FIG. 2, in the periphery of the photosensitive member 32, arranged are: a charging device 34 which charges the photosensitive member 32; a latent-image forming device 36 which irradiates the surface of the photosensitive member 32 that has been charged by the charging device 34, with a laser beam to form a latent image; a developing device 38 which develops the latent image that has been formed by the latent-image forming device 36, by a developer; a transferring device 40 which transfers the developer image that has been formed on the surface of the photosensitive member 32 by the developing device 38, onto a sheet; and a cleaning device 42 which removes way the developer that remains on the surface of the photosensitive member 32 after the developer image is transferred by the transferring device 40. In the embodiment, the latent-image forming devices 36 of the developer-image forming portions 30*a*, 30*b*, 30*c*, 30*d* are integrated with one another. Alternatively, the latent-image forming devices 36 of the developer-image forming portions 30*a*, 30*b*, 30*c*, 30*d* may be separately configured.

Among the components constituting each of the developer-image forming portions 30*a*, 30*b*, 30*c*, 30*d*, the photosensitive member 32, the charging device 34, the developing device 38, and the cleaning device 42 are integrated into a cartridge 44 which is attachable into and detachable from the image forming apparatus body 12. As shown in FIG. 3, the cartridges 44 can be attached into and detached from the image forming apparatus body 12 through the open portion which is formed by moving the transport belt 20 to the second position. In the embodiment, when the transport belt 20 is moved to the second position, both removal of a sheet in which a transportation failure occurs, and attachment and detachment of the cartridges 44 into and from the image forming apparatus body 12 are enabled. Therefore, maintenance of the image forming apparatus 10 can be easily performed.

In the embodiment, the photosensitive member 32, the charging device 34, the developing device 38, and the cleaning device 42 are integrated into the cartridge 44. Alternatively, at least a part of members respectively constituting the developer-image forming portions 30*a*, 30*b*, 30*c*, 30*d* may be integrated into the cartridges 44. For example, the latent-image forming device 36 may be added to the photosensitive member 32, the charging device 34, the developing device 38, and the cleaning device 42 to be integrated into the cartridge 44. In this case, the latent-image forming device 36 is configured by using an LED array or the like as a separate member for each of the developer-image forming portions 30*a*, 30*b*, 30*c*, 30*d*.

In the image forming apparatus body 12, a fixing device 48 for fixing the developer images which have been formed by the developer-image forming portions 30*a*, 30*b*, 30*c*, 30*d*, onto the sheet is disposed. The fixing device 48 has a heating roll 48*a*, and a pressurizing roll 48*b* which is pressingly contacted with the heating roll 48*a*. The fixing device heats the developer images, and presses the heated developer images against the sheet, thereby fixing the developer images onto the sheet.

A first sheet feeding portion 56 comprising a sheet feed cassette 54 in which sheets are accommodated is placed in the vicinity of a bottom portion in the image forming apparatus body 12. In the sheet feed cassette 54, a feed roll 58 which feeds sheets accommodated in the sheet feed cassette 54 in the sheet transport direction, and a retard roll 60 which separates the sheets from each other to prevent double feed of sheets from occurring are disposed.

A second sheet feeding portion 62 is disposed in a side of the image forming apparatus body 12 which is on the right side in FIG. 1. The second sheet feeding portion 62 has: a manual feed tray 64 which is disposed on the image forming apparatus body 12 in a state where the tray protrudes from the image forming apparatus body 12, and through which a sheet is manually fed; and a feed roll 66 which feeds the sheet from the manual feed tray 64.

One of the first and second sheet feeding portions 56, 62 is selected, and a sheet is fed from the selected sheet feeding portion to a registration roll 68. The sheet which has been fed to the registration roll 68 is fed to the above-mentioned transport belt 20 by starting the rotation of the registration roll 68 at a predetermined timing.

A placement portion 70 is disposed above the first sheet feeding portion 56. The sheet onto which the developer images have been fixed by the fixing device 48 is temporarily placed on the placement portion before the sheet is discharged to the upper discharge portion 14. A reversal roll 72 is disposed at a position which is between the placement portion 70 and the fixing device 48 in the sheet transport direction. The reversal roll 72 starts to reversely rotate after a part of the sheet onto which the developer images have been fixed by the fixing device 48 is transported to the placement portion 70, thereby transporting the sheet to the upper discharge portion 14. When the reversal roll 72 normally rotates, the roll transports the sheet onto which the developer images have been fixed by the fixing device 48, to the discharge tray 15.

On the side of the reversal roll 72 which is opposite to the side of the fixing device 48 in the sheet transport direction, a switch member 74 serving as switching means is disposed. The switch member 74 is driven by a solenoid or the like to switch whether the sheet onto which the developer image has been fixed by the fixing device 48, and which has passed through the reversal roll 72 is discharged to the discharge tray 15, or temporarily placed on the placement portion 70.

A retransport path 76 is disposed above the transport belt 20. The retransport path 76 retransports the sheet in which the developer images have been fixed onto the front face by the fixing device 48, toward the upstream side of the sheet transport direction of the transport belt 20 while the sheet is inverted. The sheet which has been transported by the retransport path 76 is fed to the transport belt 20 at a predetermined timing by the registration roll 68, and developer images are formed on the rear face of the sheet during a period when the sheet is transported by the transport belt 20.

A guide member 78 is disposed on the side of the reversal roll 72 which is on the side of the retransport path 76 in the sheet transport direction. The guide member is driven by a solenoid or the like to prevent the sheet placed on the placement portion 70 from being erroneously transported toward the fixing device 48, and guide the sheet so as to be transported to the upper discharge portion 14.

A switch member 80 serving as switching means is disposed at a position which is between the reversal roll 72 and the retransport path 76 in the sheet transport direction. The switch member 80 is driven by a solenoid or the like to switch whether the sheet which has been transported from the placement portion 70 is fed to the retransport path 76, or discharged to the upper discharge portion 14. A discharge roll 82 is disposed between the switch member 80 and the upper discharge portion 14. The sheet is discharged to the upper discharge portion 14 by the discharge roll 82.

In the thus configured image forming apparatus 10, when the image forming operation is started, a sheet is fed from one of the first and second sheet feeding portions 56, 62, and the sheet is fed to the transport belt 20 at a predetermined timing by the registration roll 68. During a period when the sheet which has been fed to the transport belt 20 is transported by the transport belt 20, developer images are formed on the sheet by the developer-image forming portions 30*a*, 30*b*, 30*c*, 30*d*. The developer images are fixed onto the sheet by the fixing device 48. Then, the sheet onto which the developer images have been fixed is transported to the reversal roll 72.

The sheet which has been transported to the reversal roll 72 is guided by the switch member 74 to one of the discharge tray 15 and the placement portion 70. Specifically, when a mode in which a sheet is discharged to the discharge tray 15 is selected, the sheet is guided to the discharge tray 15 by the switch member 74 to be discharged to the discharge tray 15. By contrast, when a mode in which a sheet is discharged to the upper discharge portion 14 is selected, the sheet is guided to the placement portion 70 by the switch member 74, and, at a timing when a part of the sheet is placed on the placement portion 70, the reversal roll 72 starts to reversely rotate, whereby the sheet is transported toward the discharge roll 82 so as to be discharged to the upper discharge portion 14 by the discharge roll 82.

When a mode in which image formation is performed on both sides of a sheet is selected, the sheet in which the developer images have been fixed onto the surface is guided to the placement portion 70 by the switch member 74, and then transported toward the switch member 80 by the reverse rotation of the reversal roll 72. The sheet is guided to the retransport path 76 by the switch member 80, and passes through the retransport path 76 to be fed to the registration roll 68. Thereafter, the sheet is fed to the transport belt 20 at a predetermined timing by the registration roll 68, and, during a period when the sheet is transported by the transport belt 20, developer images are formed on the rear face of the sheet. The developer images are fixed onto the rear side of the sheet by the fixing device 48. The sheet in which the developer images have been fixed onto the rear side is discharged to one of the discharge tray 15 and the upper discharge portion 14.

In the thus configured image forming apparatus 10, when a sheet which has been separated from the transport belt 20 is to be guided to the fixing device 48 by using guiding means such as a guide plate that guides the sheet from the lower side in the gravitational direction, the developer images formed on the sheet are disturbed because of the following reason. The developer images are in the state where the images have not yet been fixed to the sheet, and, when the images are contacted with the guiding means, the images are moved on the surface of the sheet. Moreover, the developer images are formed on the face which is downward directed in the gravitational direction, and hence easily fall off. Therefore, the developer images are disturbed more easily than unfixed developer images formed on the face which is upward directed in the gravitational direction. In order to satisfactorily perform the image formation, consequently, a sheet cannot be guided by guiding means which is disposed in the lower side in the gravitational direction, and a transportation failure easily occurs between the transport belt 20 and the fixing device 48. In the embodiment, therefore, the layout of the apparatus is improved so that a transportation failure hardly occurs between the transport belt 20 and the fixing device 48.

Figure 4A:
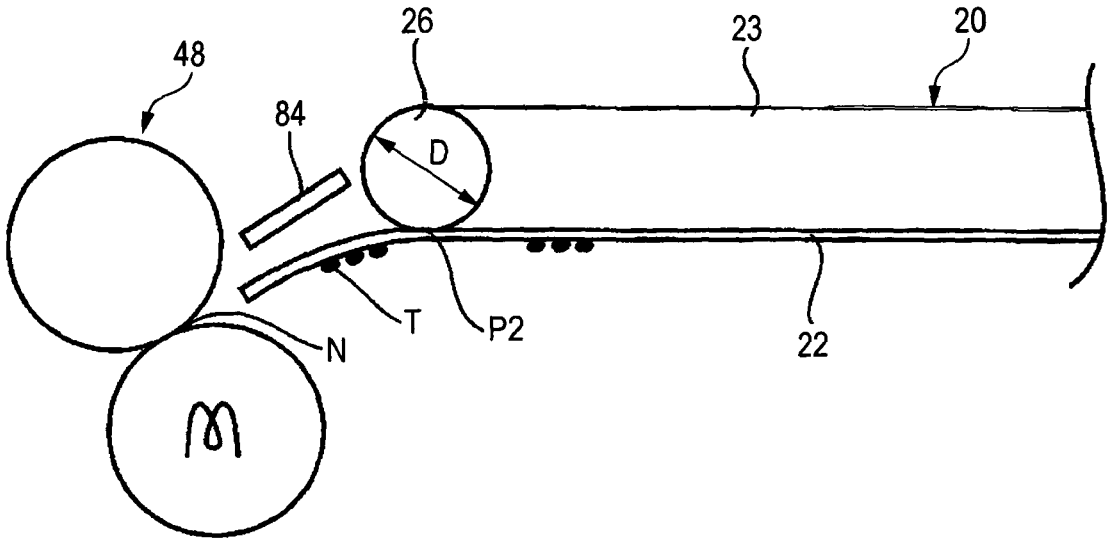
FIGS. 4A and 4B are diagram that illustrate a tension roll.

FIG. 4A shows the tension roll 26. In the embodiment, a roll having an outer diameter D of 25 mm is used as the tension roll 26. As shown in FIG. 4A, a sheet which has been transported by the transport belt 20 is separated by curvature separation from the transport belt 20 in the vicinity of the lowest position of the tension roll 26. A tip end portion of the sheet which has been separated from the transport belt 20 undergoes the gravity to be moved more downward than the position P2. In the conventional art, although it is often that a tip end portion of a sheet which has been separated from a transport belt is downward moved, a fixing device is placed so that a contact portion of the fixing portion is substantially identical in level with a sheet transport face of the transport belt. Therefore, a tip end portion of a sheet which has been separated from a transport belt sometimes fails to be suitably caught by the contact portion of the fixing portion to cause a sheet transportation failure.

In the embodiment, consequently, the fixing device 48 is placed so that a contact portion N is located lower in the gravitational direction than the transport face 22 of the transport belt 20, to enable a tip end portion of a sheet which has been separated from the transport belt 20 to be suitably caught by the contact portion N of the fixing device 48, and hence a sheet transportation failure hardly occurs between the transport belt 20 and the fixing device 48.

Figure 4B:
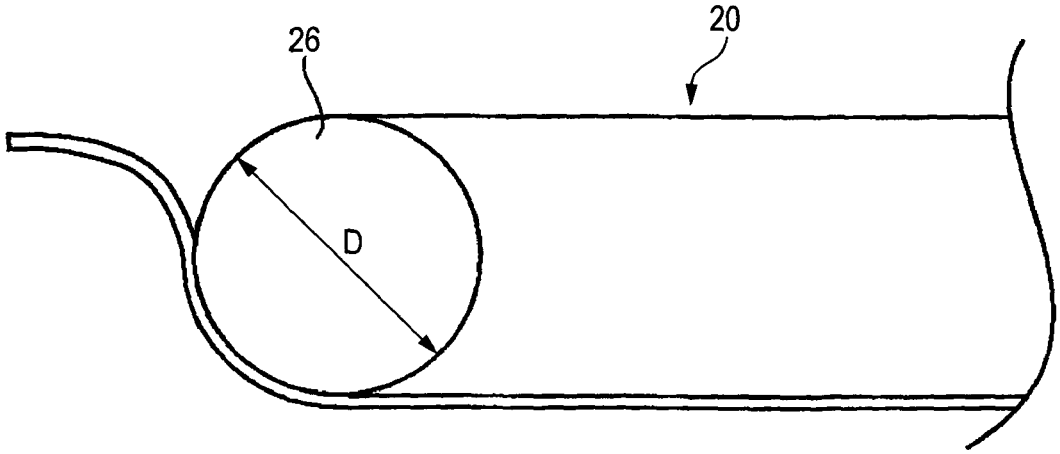

FIG. 4B shows a tension roll 26 of a comparison example. In the image forming apparatus 10 of the embodiment, a sheet is separated by curvature separation from the transport belt 20 in the vicinity of the lowest position of the tension roll 26, and a tip end portion of the sheet undergoes the gravity to be moved more downward than the position P2. By contrast, in the comparison example, as shown in FIG. 4B, curvature separation of a sheet is not performed at the lowest position of the tension roll 26, and the sheet remaining in the state where it is sucked to the transport belt 20 is transported, and then separated from the transport belt 20.

The difference in sheet behavior is caused by that in outer diameter of the tension roll 26 which is disposed in the back side of the position P2 of the transport belt 20 where a sheet is separated. Namely, in the case where the outer diameter D of the tension roll 26 is sufficiently small as shown in FIG. 4A, a sheet is separated from the transport belt 20 in the vicinity of the lowest position of the tension roll 26. By contrast, in the case where the outer diameter D of the tension roll 26 is large, a sheet is sometime separated by curvature separation at the lowest position of the tension roll 26, and, as shown in FIG. 4B, curvature separation is sometimes not performed at the lowest position of the tension roll 2 and a sheet is separated from the transport belt 20 after the sheet is transported while remaining in the state where it is sucked to the transport belt 20. Furthermore, a situation sometimes occurs where a sheet is not separated from the transport belt 20 and goes around to the upward directed face of the transport belt 20. In the case where the outer diameter of the tension roll 26 is large, the behavior of a sheet which has been transported by the transport belt 20 depends on the kind of the sheet, the state of the sheet, the temperature and humidity in the image forming apparatus 10, etc. Therefore, it is difficult to anticipate or control the position where a sheet is separated from the transport belt 20.

The inventors conducted experiments of performing transportations in the image forming apparatus 10 at different temperatures and humidities, by using transport belts 20 in which plural kinds of sheets made of plural kinds of materials are used. As a result, it was found that irrespective of other conditions, when the outer diameter D of the tension roll 26 is 30 mm or less, sheets are generally separated in the vicinity of the lowest position of the tension roll 26 as shown in FIG. 4A. In the image forming apparatus 10 of the embodiment, therefore, the outer diameter of the tension roll 26 is set to be equal to or smaller than 30 mm or set to 25 mm, so that a sheet is separated from the transport belt 20 in the vicinity of the lowest position of the tension roll 26. In the embodiment, the outer diameter D of the tension roll 26 is 25 mm. However, the outer diameter D may have any value as far as it is equal to or smaller than 30 mm. Preferably, the outer diameter D is made smaller as far as restrictions are not imposed by the other conditions. The configuration where the outer diameter is 25 mm or less is more preferable than that where the outer diameter is 30 mm or less. The configuration where the outer diameter is 20 mm or less is more preferable than that where the outer diameter is 25 mm or less. The configuration where the outer diameter is 15 mm or less is more preferable than that where the outer diameter is 20 mm or less. Furthermore, the configuration where the outer diameter D is 10 mm or less is more preferable than that where the outer diameter is 15 mm or less.

In this way, the configuration where the fixing device 48 is placed so that the contact portion N of the fixing device 48 is located lower in the gravitational direction than the transport face 22 is employed together with that where the outer diameter D of the tension roll 26 is set to a value at which a sheet is separated in the vicinity of the lowest position of the tension roll 26, so that a transportation failure at a position between the transport belt 20 and the fixing device 48 more hardly occurs.

A guide member 84 configured by a guide plate or the like is disposed between the transport belt 20 and the fixing device 48. The guide member 84 guides the sheet transportation from the upper side in the gravitational direction. Therefore, the member is not contacted with unfixed developer images T formed on the face of the sheet which is downward directed in the gravitational direction, and hence the developer images T are not disturbed. Even in a rare case where a sheet is separated from the transport belt 20 after the sheet is transported while remaining in the state where it is sucked to the transport belt 20, the disposition of the guide member 84 enables the sheet to be guided by the guide member 84, whereby a tip end portion of the sheet is guided to the contact portion N of the fixing device 48.

Figure 5:
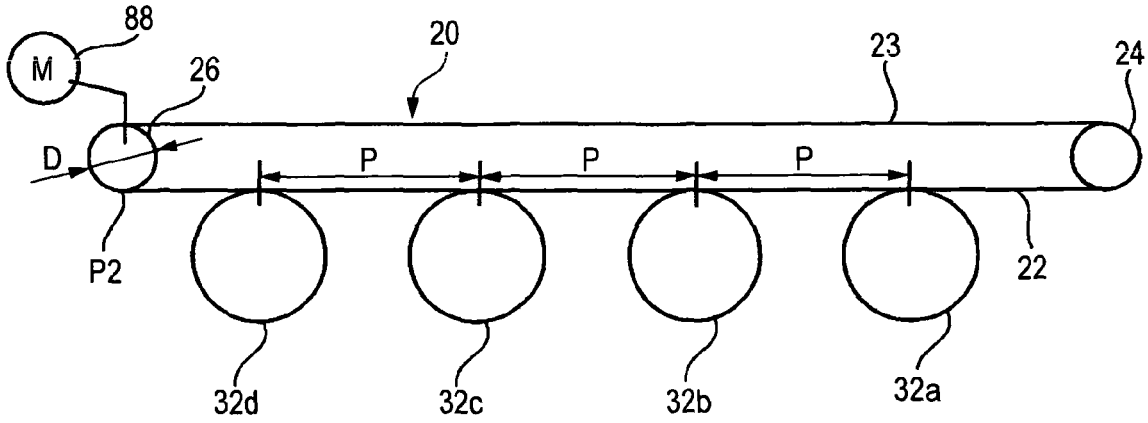
FIG. 5 is a second diagram that illustrates a tension roll used in the embodiment of the invention.

FIG. 5 shows the tension roll 26 in the same manner as FIG. 4A. In the embodiment, the tension roll 26 is used as a driving roll, and coupled with a driving source 88 such as a motor so as to receive a driving force from the driving source 88 to be rotated, thereby rotating the transport belt 20. In the case where the tension roll 26 is used as a driving roll, an upper portion 23 of the transport belt 20 which is located above the tension roll 26 is moved by pushing by the tension roll 26 toward the right side in FIG. 5. Therefore, the upper portion 23 is formed as a so-called loosed side, and stretched while forming slack of a certain degree between the tension rolls 26, 24.

By contrast, the side of the transport face 22 which is located below the tension roll 26 of the transport belt 20 is moved by pulling by the transport belt 20. Therefore, the side of the transport face 22 is formed as a so-called tensioned side, and a sheet is stretched without slack between the tension rolls 24, 26. In the image forming apparatus 10 in which a sheet is transported by the tensioned side of the transport belt 20 and plural developer images are superimposed on the sheet to form a color image, the outer peripheral length of the tension roll 26 which is used also as a driving roll must be equal to the distance P between the photosensitive members 32. Namely, the outer diameter D of the tension roll 26 is set so that the following relationship is established between the outer diameter D of the tension roll 26 and the distance P, and the photosensitive members 32 are arranged in the image forming apparatus.

$$P=\pi\cdot D$$

In the case where the above relationship is not established, such as the case where eccentricity of the tension roll 26 causes the tension roll 26 to be unevenly rotated and the sheet transportation speed of the transport belt 20 is periodically varied by the uneven rotation, expansions and contractions of developer images to be transferred onto a sheet are caused by the variation of the speed, and the expansions and contractions on the photosensitive members 32 are not coincident with one another, thereby causing color shift. In the image forming apparatus 10 of the embodiment of the invention, therefore, the outer diameter D of the tension roll 26 must be determined in accordance with the distance P between the photosensitive members 32.

In order to miniaturize the image forming apparatus 10, it is required to shorten the distance P between the photosensitive members 32. In order to shorten the distance P, a roll having a small outer diameter D must be used as the tension roll 26. When the outer diameter D of the tension roll 26 is reduced, the sheet which has been separated from the transport belt 20 undergoes the gravity to be transported more downward than the position P2 as described above (see FIG. 4A). When, as in the conventional art, the fixing device is placed so that the contact portion of the fixing portion is substantially identical in level with the transport face of the sheet transport belt, a tip end portion of a sheet sometimes fails to be suitably caught by the contact portion N of the fixing portion to cause a sheet transportation failure. By contrast, in the embodiment, the fixing device 48 is placed so that the contact portion N of the fixing device 48 is located lower in the gravitational direction than the transport face 22, and hence the tip end portion of the sheet which has been separated from the transport belt 20 is suitably caught by the contact portion N of the fixing device 48, and hence a sheet transportation failure hardly occurs between the transport belt 20 and the fixing device 48.

In the image forming apparatus 10, the fixing device 48 is placed so that the contact portion N of the fixing device 48 is located lower in the gravitational direction than the transport face 22 of the transport belt 20, thereby enabling a roll having a small outer diameter D to be used as the tension roll 26. When a roll having a small outer diameter D is enabled to be used as the tension roll 26, the distance P between the photosensitive members 32 can be shortened, whereby the image forming apparatus 10 can be miniaturized.

As described above, in the image forming apparatus 10, the fixing device 48 is placed so that the contact portion N of the fixing device 48 is located lower in the gravitational direction than the transport face 22 of the transport belt 20. Therefore, a sheet is transported from the transport belt 20 to the contact portion N of the fixing device 48 while the sheet is downward directed. When a sheet which has passed through the contact portion N is to be directly discharged to the upper discharge portion 14, therefore, the sheet which has been transported while being downward directed must be largely bent in the sheet transport path to be transported while being upward directed. This causes a transportation failure to easily occur. In the image forming apparatus 10, therefore, a sheet onto which developer images have been fixed is temporarily placed on the placement portion 70, and the sheet is transported to the upper discharge portion 14 by reversely rotating the reversal roll 72 as described above, thereby causing a transportation failure to hardly occur.

As described above, the invention can be applied to an image forming apparatus having a transport belt for transporting a sheet, for example, plain paper, such as a copier, a facsimile apparatus, or a printer.

What is claimed is:

1. An image forming apparatus comprising:

a body;

a transport belt that comprises a transport face, which is downward directed in the gravitational direction, and that transports the sheet while supporting the sheet on the transport face;

a plurality of developer-image forming portions that form a developer image on the sheet transported by transport belt;

a fixing device that comprises a contact portion disposed at a lower position than the transport face, and that fixes the developer image on the sheet by the contact portion; and a tension roll that stretches the transport belt;

wherein each of the plurality of developer-image forming portions includes an image carrier, respectively, wherein P is substantially equal to $\pi\times D$, wherein P is a distance between a first nip portion of a first image carrier and second nip portion of a second image carrier, adjacent to the first image carrier, and D is a diameter of the tension roll; and wherein the diameter of the tension smaller than a diameter of each of the image carriers.

2. An image forming apparatus according to claim 1, wherein the tension roll comprises a driving roll that drives the transport belt, and that is disposed in a position where the sheet is separated from the transport belt.

3. An image forming apparatus according to claim 2, wherein the tension roll has an outer diameter of 30 mm or less.

4. An image forming apparatus according to claim 1, wherein at least a part of the developer-image forming portion is integrated into a cartridge being attachable into and detachable from the body.

5. An image forming apparatus according to claim 4, wherein the transport belt is provided at a closable cover so that the transport belt is movable between a first position and a second position, the first position being a position where the transport belt is placed in operation of the image forming apparatus, and the second position being a position where the transport belt is placed in maintenance of the image forming apparatus, and the cartridge is attached into and detached from the body through an open portion formed between the body and the transport belt placed in the second position.

6. An image forming apparatus according to claim 1, which comprises:

a discharge portion that is disposed in an upper portion of the body, and to which the sheet is discharged;

a placement portion that temporarily places the sheet discharged from the discharge portion; and a reversal roll that starts to reversely rotate after a part of the sheet, the sheet being fixed the developer image by the fixing device, is transported to the placement portion, and that transports the sheet to the discharge portion.

7. An image forming apparatus according to claim 1, which comprises:

a retransport path that retransports the sheet, the sheet being fixed the developer image by the fixing device, to an upstream side of the transport belt while inverting the sheet.

8. An image forming apparatus according to claim 1, which comprises:

a guide member that is disposed between the transport belt and the fixing device, and that guides transportation of the sheet from an upper side.

9. The image forming apparatus according to claim 1, wherein the developer-image forming portion forms the developer image on the sheet when the sheet is being transported by the transport face of the transport belt.

10. The image forming apparatus according to claim 1, wherein developer images corresponding to plural of colors are superimposed on the sheet transported by the transport belt.

* * * * *